United States Patent [19]

Watanabe et al.

[11] 4,308,842

[45] Jan. 5, 1982

[54] EVAPORATIVE EMISSION CONTROL SYSTEM FOR AN INTERNAL COMBUSTION ENGINE

[75] Inventors: Masao Watanabe, Niiza; Osamu Goto, Higashikurume; Yasuji Uozumi, Tokyo, all of Japan

[73] Assignee: Honda Giken Kogyo Kabushiki Kaisha, Tokyo, Japan

[21] Appl. No.: 80,780

[22] Filed: Sep. 28, 1979

[30] Foreign Application Priority Data

Oct. 2, 1978 [JP] Japan ..... 53/135655

[51] Int. Cl.[3] ..... F02M 59/00

[52] U.S. Cl. ..... 123/520; 123/519

[58] Field of Search ..... 123/518, 519, 520

[56] References Cited

U.S. PATENT DOCUMENTS 3,001,519 9/1961 Dietrich ..... 123/520
3,680,318 8/1972 Nakajima ..... 123/519
3,913,545 10/1975 Haase ..... 123/520
4,176,639 12/1979 Shinoda ..... 123/520

*Primary Examiner*—Ronald H. Lazarus
*Attorney, Agent, or Firm*—Armstrong, Nikaido, Marmelstein & Kubovcik

[57] ABSTRACT

An evaporative emission control system for an internal combustion engine, in which fuel vapors generated in a fuel reservoir are stored in a fuel vapor storage canister when the engine is stopped so that the fuel vapors may be used when the engine is in operation. A purge control valve is disposed on a discharge port of the canister. The purge control valve is designed so that it is not opened unless a temperature of the engine exceeds a level above a predetermined threshold even when the engine is in operation. When the engine is operated at a low temperature, the stored fuel vapors in the canister are not released for stabilization in the air-fuel ratio of a mixture fed to the engine, and when the engine is operated at a high temperature, the stored fuel vapors are released into the engine to effectively consume the fuel.

6 Claims, 1 Drawing Figure

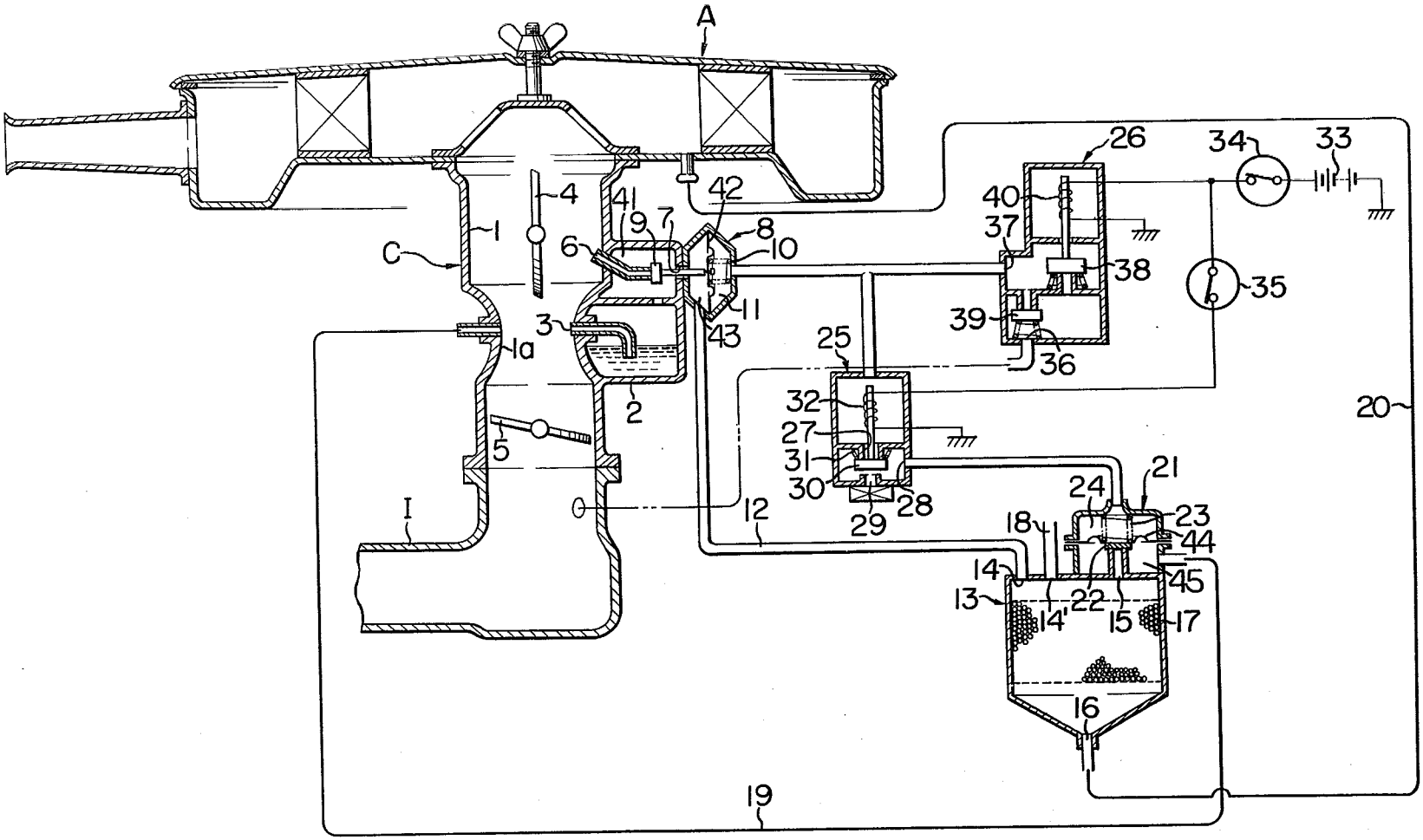
20
33
34
35
26
38
36
40
37
39
21
23
44
45
17
15
24
22
16
18
14
13
28
29
25
32
27
31
30
12
19
8
10
11
42
43
A
7
9
41
6
2
4
3
1a
5
1
C
I

EVAPORATIVE EMISSION CONTROL SYSTEM FOR AN INTERNAL COMBUSTION ENGINE

BACKGROUND OF THE INVENTION

1. Field of the Invention

This invention relates to an evaporative emission control system for an internal combustion engine, in which a vapor storage canister adsorbs fuel vapors generated in fuel reservoirs such as a float chamber in a carburetor and a fuel tank when the engine is stopped so that fuel vapors stored in the canister may be released into an intake passage of the engine during engine operation in order to prevent contamination of the atmosphere and save fuel.

2. Description of the Prior Art

In prior art the fuel vapors stored in such a canister have been purged, as controlled, into an intake passage of engine through a purge control valve which is operated by an intake vacuum pressure in accordance with engine operating conditions. However, the quantity of fuel vapors adsorbed by or desorbed from the canister is indefinite. Therefore, fuel vapors released into the intake passage unstabilize an air-fuel ratio of mixture during operation of the engine. A mixture supplied to the engine, particularly during engine operation at low temperature, is required to stabilize its rich air-fuel ratio because this change of air-fuel ratio of the mixture due to the induction of fuel vapors brings about an incomplete combustion and an increase in amount of pollutants emitted from the engine.

SUMMARY OF THE INVENTION

It is therefore an object of the present invention to provide an improved evaporative emission control system for a vehicle engine having a purge control valve in the passage between a vapor storage canister and an intake passage of the engine, the system being operative to regulate the flow of fuel vapors from the canister to the intake passage.

Another object of the present invention is to improve a vehicle engine evaporative emission control system by the incorporation of a temperature responsive valve whereby, during engine operation at a low temperature, the purge control valve is moved to a closed position to prevent the flow of fuel vapors from the canister to the intake passage.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the drawing, the single FIGURE is a schematic view of one form of an evaporative emission control system in accordance with the present invention.

DESCRIPTION OF THE PREFERRED EMBODIMENT

Turning now to the drawing, a carburetor C connected to an upper end of an intake pipe I of an engine comprises an intake passage 1, a float chamber 2 formed externally thereof, a fuel nozzle 3 risen from a level below the fuel oil level in the float chamber 2 and extending into a venturi 1*a* of the intake passage 1, a choke valve 4 disposed upwardly of the venturi 1*a*, and a throttle valve 5 disposed downwardly thereof in a conventional manner. The float chamber 2 has an upper chamber 41 communicated with an upper portion of the venturi 1*a* through a vent pipe 6. An opening 7 is located on one side of the upper chamber 41, and between the opening 7 and the vent pipe 6 there is disposed a valve body 9 connected to a diaphragm 42 of a vacuum operated valve as generally indicated by numeral 8. The vacuum operated valve 8 includes a vacuum chamber 11 and a chamber 43 divided by the diaphragm 42 on the opposite sides thereof, the vacuum chamber 11 being in communication with the intake pipe I through a vacuum signal valve 26 to be described later whilst the chamber 43 being in communication with the upper chamber 41 of the float chamber 2 through the aperture 7. Disposed in the vacuum chamber 11 is a spring 10 which acts to urge the diaphragm 42 and hence the valve body 9 in a direction to close the vent pipe 6 and at the same time to open the aperture 7.

The chamber 43 of the vacuum operated valve 8 is in communication with an inlet 14 of a fuel vapor storage canister 13 through a conduit 12. The canister 13 is provided at the upper side with inlets 14, 14' and a discharge port 15 and at the lower side with an atmospheric port 16. The canister 13 contains a fuel vapor adsorbent 17 such as active carbon. Connected to the inlet 14' is a conduit 18 in communication with an upper space of a fuel tank (not shown). Connected to the atmospheric port 16 is an air pipe 20 in communication with an air cleaner A of the carburetor C.

Disposed on the discharge port 15 is a valve body 22 which is connected to a diaphragm 44 of a purge control valve 21. The purge control valve 21 includes a vacuum chamber 24 and a chamber 45 divided by the diaphragm 44 on the opposite sides thereof, the vacuum chamber 24 being in communication with the intake pipe I through the electromagnetic valve 25 and the vacuum signal valve 26 whilst the chamber 45 being in communication through the valve body 22 with the discharge port 15 and through a conduit 19 with the venturi 1*a* of the carburetor C. A spring 23 is disposed in the vacuum chamber 24 for urging the diaphragm and hence the valve body 22 in a direction to close the discharge port 15.

The electromagnetic valve 25 has an inlet 27 in communication with the vacuum signal valve 26, an outlet 28 in communication with the vacuum chamber 24 of the purge control valve 21, and an atmospheric opening 29 so that the inlet 27 and atmospheric opening 29 are alternately opened and closed by a valve body 30 so as to bring the outlet 28 into selective communication with the inlet 27 or the atmospheric opening 29. The valve body 30 is always urged in the closing direction of the atmospheric opening 29 by means of a spring 31, but the inlet 27 can be closed against the spring 31 by exciting a solenoid 32. An electric circuit, which connects between the solenoid 32 and a power source 33, incorporates an ignition switch 34 and an engine temperature sensing switch 35, which are connected in series. The engine temperature sensing switch 35 is of the normally closed type in which it is opened when the temperature of the engine exceeds a predetermined threshold level, for example, when the temperature of cooling water of the engine exceeds 75° C.

The vacuum signal valve 26 has, in its valve box, an inlet 36 in communication with the intake pipe I of the engine and an outlet 37 in communication with the vacuum operated valve 8 and the electromagnetic valve 25. Interposed between the inlet 36 and the outlet 37 are a solenoid valve 38 and a check valve 39, which are arranged in parallel. The check valve 39 is provided to transmit only the unidirectional vacuum pressure from the inlet 36 to the outlet 37. The solenoid valve 38 is the normally open type in which it is closed when a solenoid 40 is energized. The solenoid 40 is connected to the power source 33 through only the ignition switch 34.

In the operation of the present invention, and when the engine is stopped, the ignition switch 34 is opened so that the solenoid valve 38 of the vacuum signal valve 26 is placed in an open state. As a result, the vacuum chamber 11 of the vacuum operated valve 8 is placed into communication through the now opened solenoid valve 38 with the intake pipe I under the atmospheric pressure, whereby the valve body 9 is moved to close the vent pipe 6 and to open the opening 7.

On the other hand, in the electromagnetic valve 25, as the ignition switch 34 opens, the atmospheric opening 29 is closed and the inlet 27 and outlet 28 are brought into communication, whereby the vacuum chamber 24 of the purge control valve 21 comes into communication with the intake pipe I through the electromagnetic valve 25 and solenoid valve 38 to lose vacuum pressure within the chamber 24 so that the purge control valve 21 is actuated to close the discharge port 15.

Accordingly, when fuel vapors are generated in the float chamber 2 under the influence of remaining heat or the like of the engine body, the fuel does not escape from the vent pipe 6 but enters the inlet 14 of the canister 13 via the opening 7 and conduit 12, and the fuel is adsorbed by the adsorbent 17 to prevent outflow thereof through the atmospheric opening 16. However, the pressure within the float chamber 2, which increases as the fuel vapors are generated, is released outside from the atmospheric opening 16, and with this release of pressure, irregular ejection of fuel within the float chamber 2 from the nozzle 3 can be avoided.

Also, fuel vapors generated in a fuel tank not shown enters the inlet 14' of the canister 13 via the conduit 18 and then is adsorbed by the adsorbent 17 in a manner similar to that as previously described, thereby preventing atmospheric contamination due to the fuel vapors.

Next, when the ignition switch 34 is closed to run the engine, the solenoid valve 38 is placed in a closed state so the vacuum pressure introduced from the intake pipe I into the vacuum signal valve 26 causes the check valve 39 to open and enters the chamber 11 of the vacuum operated valve 8, whereby the valve 8 is actuated to close the opening 7 and to open the vent pipe 6. As a consequence, atmospheric pressure is introduced into the float chamber 2 through the vent pipe 6 so that fuel is ejected freely from the fuel nozzle 3, without any obstacle, in accordance with the vacuum pressure within the venturi 1*a*. Since back flow of vacuum pressure from the vacuum chamber 11 to the intake pipe I can be precluded by the action of the check valve 39 by the accelerating operation or the like for rapidly opening the throttle valve 5 during the operation of the engine, even if the vacuum pressure of the intake pipe I extremely decreases, the communication condition of the vent pipe 6 may be maintained.

If the temperature of cooling water for the engine does not yet reach the predetermined level, 75° C., during the operation of the engine, the normally closed type engine temperature sensing switch 35 maintains its closed state and hence, the electromagnetic valve 25 with the solenoid 32 excited causes the inlet 27 to close and permits the outlet 28 and atmospheric opening 29 to be communicated, so that the vacuum chamber 24 of the purge control valve 21 is placed in a state open to atmosphere whereby the purge control valve 21 still keeps the discharge port 15 closing. Accordingly, the vacuum pressure generated in the venturi 1*a* of the carburetor C does not at all act on the canister 13 and the fuel vapors stored therein are not released.

However, when the temperature of cooling water for the engine exceeds 75° C., the engine temperature sensing switch 35 senses the temperature and opens, so that the electromagnetic valve 25 with the solenoid 32 deenergized, causes the atmosphere opening 29 to close and permits the inlet 27 and outlet 28 to be communicated and the vacuum pressure of the intake pipe, having passed through the check valve 39, is introduced into the vacuum chamber 24 of the purge control valve 21 whereby the discharge port 15 is opened by the purge control valve 21. As a result, by the action of the vacuum pressure generated in the venturi 1*a* of the carburetor C, external air cleaned by the air cleaner A passes through the air pipe 20 and enters the canister 13 from the atmospheric opening 16 to free the fuel vapors from the adsorbent 17. Furthermore, the air along with the fuel is taken into the venturi 1*a* via the discharge port 15 and conduit 19, that is, the stored fuel is released and is supplied to the engine together with the mixture formed in the intake passage 1.

In accordance with the present invention, as described above, the purge control valve 21 disposed on the discharge port 15 of the canister 1 is designed so that the valve 21 is not opened unless the temperature exceeds a level above the predetermined threshold value even when the engine is in operation. With this, when the engine is operated at a low temperature below the predetermined level or value, the stored fuel in the canister 13 is not released and accordingly, the mixture can be made richer properly by closing the choke valve 4 without being affected by the stored fuel to stabilize the operating condition at a low temperature and to decrease the density of unburnt components in the exhaust. Also, when the engine is operated at a high temperature, the fuel stored in the canister 13 can be released into the engine in the conventional manner to effectively consume the fuel, thus preventing atmospheric contamination due to the vaporized fuel and loss of fuel.

Without further analysis, the foregoing will so fully reveal the gist of the present invention that others can, by applying current knowledge, readily adapt it for various applications without omitting features that, from the stand-point of prior art, fairly constitute essential characteristics of the generic or specific aspects of the invention, and therefore, such adaptations should and intended to be comprehended within the meaning and range of equivalence of the following claims.

What is claimed is:

1. An evaporative emission control system for an internal combustion engine, comprising:

a fuel vapor storage canister having an inlet and a discharge port opened at one side thereof and an atmospheric opening opened at the other side thereof, said inlet communicating with an upper chamber in a fuel reservoir, said discharge port communicating with an intake passage of a carburetor;

a fuel vapor adsorbent filled in said canister; and a purge control valve disposed on said discharge port for normally closing said discharge port, said purge control valve being adapted to be opened when a temperature of the engine exceeds a predetermined level during operation of the engine;

said purge control valve comprising:

a valve body disposed on said discharge port;

spring means for urging said valve body towards a closing relation to said discharge port;

a vacuum chamber communicating with an intake passage of the engine through an electromagnetic valve and a vacuum signal valve for opening said valve body against said spring means when vacuum pressure enters;

said electromagnetic valve having an atmospheric opening, an inlet in communication with said vacuum signal valve, and an outlet in communication with said vacuum chamber, said inlet and said atmospheric opening of said electromagnetic valve being alternately opened and closed for bringing said outlet of said electromagnetic valve into selective communication with said inlet and said atmospheric opening thereof.

2. An evaporative emission control system as defined in claim 1, wherein said fuel reservoir comprises a float chamber.

3. An evaporative emission control system for an internal combustion engine, comprising:

a fuel vapor storage canister having an inlet and a discharge port opened at one side thereof and an atmospheric opening opened at the other side thereof, said inlet communicating with an upper chamber in a fuel reservoir, said discharge port communicating with an intake passage of a carburetor;

a fuel vapor adsorbent filled in said canister; and a purge control valve disposed on said discharge port for normally closing said discharge port, said purge control valve being adapted to be opened when a temperature of the engine exceeds a predetermined level during operation of the engine;

said purge control valve comprising:

a valve body disposed on said discharge port;

spring means for urging said valve body towards a closing relation to said discharge port;

a vacuum chamber communicating with an intake passage of the engine through an electromagnetic valve and a vacuum signal valve for opening said valve body against said spring means when vacuum pressure enters;

said electromagnetic valve having an atmospheric opening, an inlet in communication with said vacuum signal valve, and an outlet in communication with said vacuum chamber, said inlet and said atmospheric opening of said electromagnetic valve being alternately opened and closed for bringing said outlet of said electromagnetic valve into selective communication with said inlet and said atmospheric opening thereof;

said electromagnetic valve further including a valve member, a spring urging said valve member in a direction to close said atmospheric opening and to open said inlet of said electromagnetic valve, solenoid means operable, upon energization, to move said valve member against said spring in a direction to close said inlet and to open said atmospheric opening, said solenoid means being connected to a power source through electric circuit means having ignition switch means and engine temperature sensing switch means connected in series, said engine temperature sensing switch means being a normally closed switch adapted to open when the temperature of the engine exceeds a predetermined threshold level dependent on the temperature of cooling water of the engine.

4. An evaporative emission control system as defined in claim 3, wherein said vacuum signal valve includes a valve box with an inlet communicating with an intake pipe of the engine and an outlet communicating with said electromagnetic valve.

5. An evaporative emission control system as defined in claim 4 including a solenoid valve between said inlet and outlet of said valve box; and a check valve connected in parallel with said solenoid valve.

6. An evaporative emission control system as defined in claim 5, wherein said check valve transmits only unidirectional vacuum pressure from said inlet to said outlet of said valve box, said solenoid valve being a normally open valve which is closed when a solenoid is energized by being connected to said power source through said ignition switch means.

* * * * *